US005320296A

United States Patent [19]

Ozcariz et al.

[11] Patent Number: 5,320,296

[45] Date of Patent: Jun. 14, 1994

[54] ROLL HANDLING MACHINE

[76] Inventors: Laureano Ozcariz; Ricardo Huarte; Jesus Grocin; Jose M. Huarte, all of Poligono Landaben, Calle C, s/n., 31012 Pamplona-Navarra, Spain

[21] Appl. No.: 922,181

[22] Filed: Jul. 30, 1992

[51] Int. Cl.[5] ..... B65H 16/06

[52] U.S. Cl. ..... 242/58.6; 242/54 R

[58] Field of Search ..... 242/58–58.6, 242/68.4, 54 R

[56] References Cited

U.S. PATENT DOCUMENTS

| | | | |
|---|---|---|---|
| 2,499,562 | 3/1950 | Behrens | 242/58.6 |
| 3,323,742 | 6/1967 | Giraud | 242/58.6 |
| 3,743,198 | 7/1973 | Lucas | 242/58.6 |
| 4,693,433 | 9/1987 | Martin | 242/58.6 |
| 4,930,713 | 6/1990 | Sato et al. | 242/58.6 |
| 5,004,173 | 4/1991 | Kawai | 242/58.6 X |
| 5,025,998 | 6/1991 | Hutzenlaub et al. | 242/58.6 X |
| 5,060,878 | 10/1991 | Hutzenlaub et al. | 242/58.6 X |

FOREIGN PATENT DOCUMENTS

| | | | |
|---|---|---|---|
| 63-252859 | 10/1988 | Japan | 242/58 |
| 1-117158 | 5/1989 | Japan | 242/58 |
| 1-267238 | 10/1989 | Japan | 242/58.1 |
| 2106875 | 4/1983 | United Kingdom | 242/58.1 |

*Primary Examiner*—Joseph J. Hail, III
*Assistant Examiner*—John P. Darling
*Attorney, Agent, or Firm*—Lucas & Just

[57] ABSTRACT

A roll handling machine, with frame members on a fixed frame (1) bearing roll-bearing arms (3) arranged in pairs which when mounted on their corresponding supports (2) can move towards or away from each other, characterised in that each roll-bearing arm (3) is mounted in a moving frame (4) with a device for displacement in the fixed frame (1) between two extreme positions, each roll-bearing arm (3) comprising a device (5) for tilting angular displacement with respect to the moving frame (4) in which it is mounted, each support (2) being associated with an extender device (7) which enables it to be positioned with respect to the piston (41*b*) in at least two working positions and each pair of roll-bearing arms (3) located in a given moving frame (4) being associated with a device (8) for decentering the shafts (6) for a given roll to achieve a uniform tension throughout the width thereof when working. Applications in the handling of rolls of paper, plastics or the like, of great size and/or weight.

3 Claims, 2 Drawing Sheets

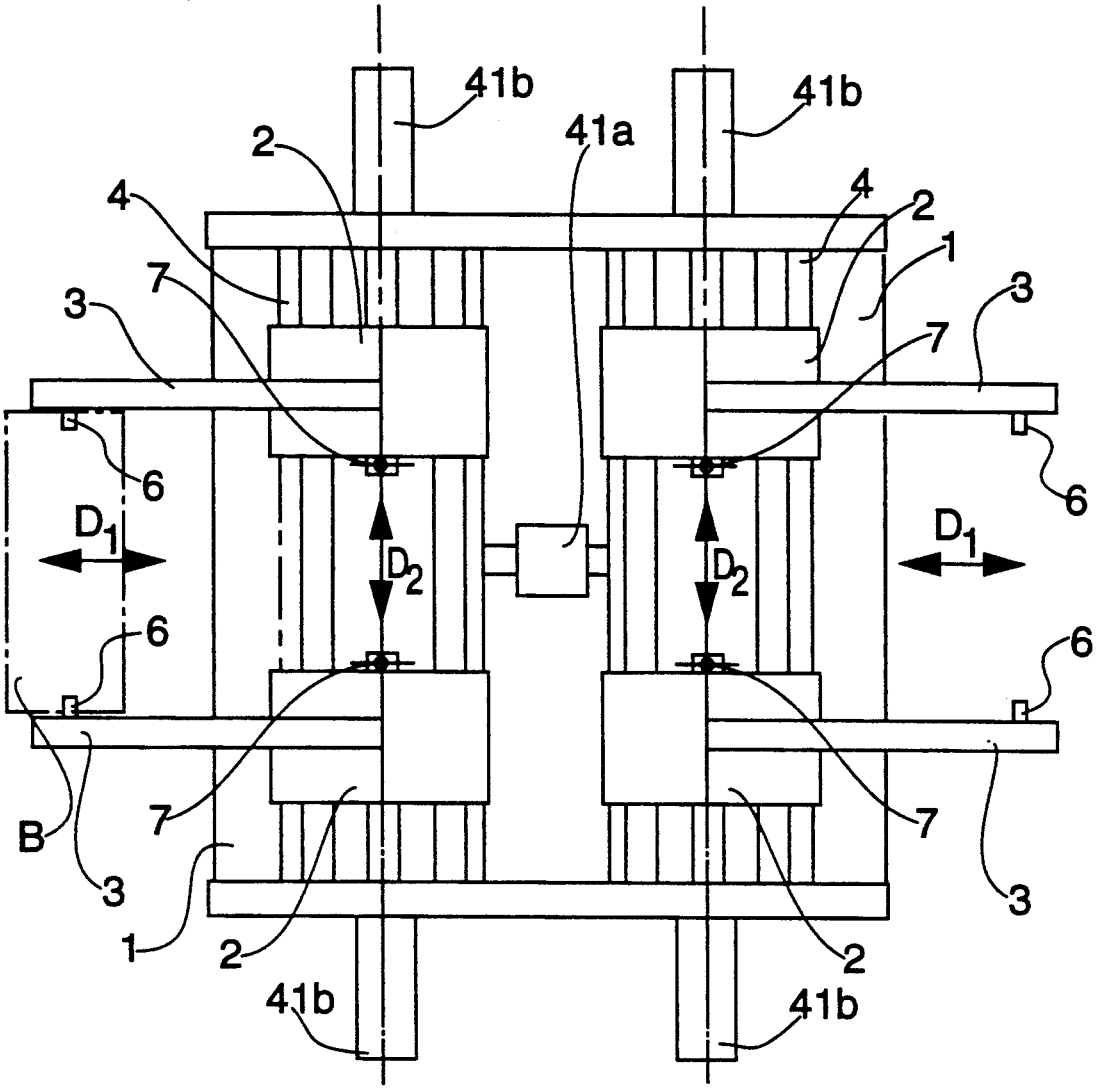
FIG. 1
FIG. 2
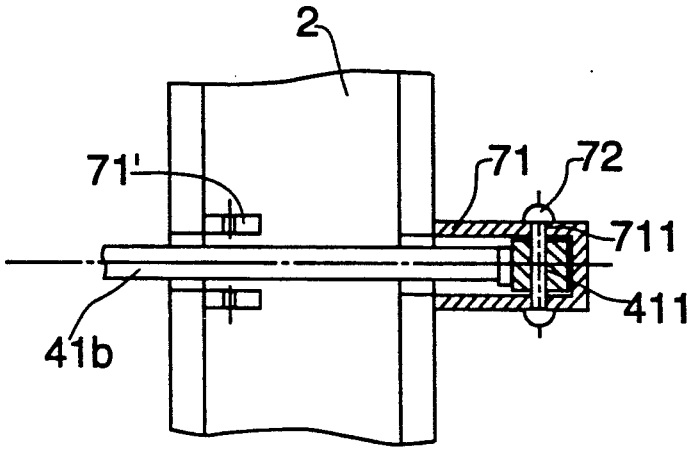

FIG. 3B
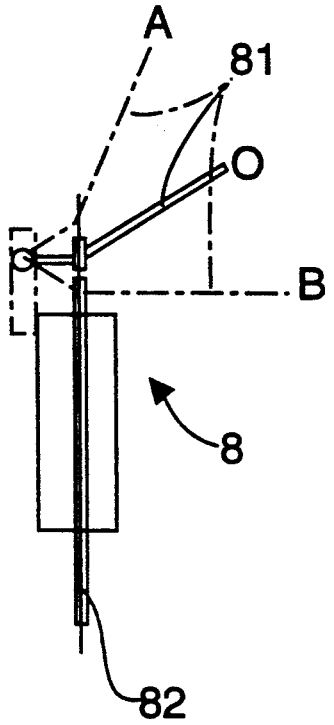
FIG. 3A
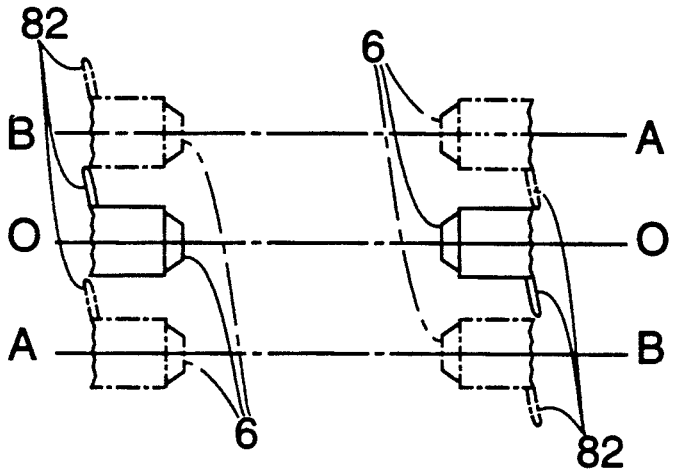
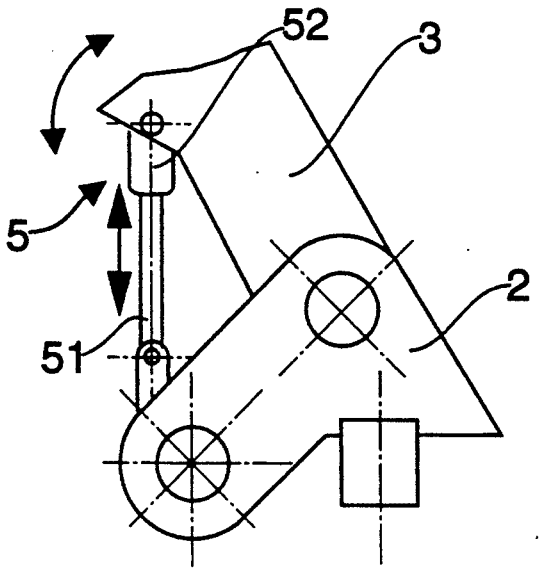
FIG. 4

ROLL HANDLING MACHINE

BACKGROUND OF THE INVENTION

1. Field of the Invention

This invention relates to a roll handling machine.

2. Description of the Prior Art

Machines for the handling of rolls, particularly rolls of paper or plastics, are currently known.

These rolls can be of considerable size and weight.

The limitations of existing machines are essentially brought about by the small amount of freedom for the roll-bearing arms, which makes the work of handling difficult.

A rigid structure for the roll supports makes the work of loading and unloading rolls difficult.

SUMMARY OF THE INVENTION

It is an object of the invention to provide a new or improved roll handling machine.

According to the invention there is provided a roll handling machine comprising frame members in a fixed frame bearing roll-bearing arms arranged in pairs which when mounted on their corresponding supports can move towards or away from each other, wherein:

a) each roll-bearing arm is mounted on a moving frame with means to displace it between two extreme positions in the fixed frame, b) each roll-bearing arm comprises means for tilting angular displacement with respect to the moving frame in which it is mounted, c) each support is associated with an extender device which allows it to be positioned with respect to the piston into at least two working positions, d) each pair of roll-bearing arms mounted in a given moving frame is associated with a device for decentering the shafts for a given roll to achieve a uniform tension throughout the width of the roll when working.

Each extender device may comprise associated supports, at least one of which emerges at right angles with respect to the moving frame coaxially with the piston member, these supports comprising orifice means, in one or other of which the piston member of the piston can be anchored to vary the amplitude of the displacement of the corresponding roll-bearing arm.

Each decentering device for the shafts bearing a given roll may comprise a lever associated with a hydraulic circuit which displaces the roll-bearing shafts from a coaxial equilibrium position in a conjugated and opposing movement.

The longitudinal displacement of the moving frame with respect to the fixed frame may be brought about using:

a) longitudinal female guides constructed in the fixed frame which house associated male guides constructed on the moving frame, b) hydraulic pistons of which one part, the body, is mounted on the fixed frame and the other part, the piston, is mounted on the moving frame.

The tilting angular displacement of each roll handling arm with respect to the corresponding frame may be brought about by means of hydraulic pistons of which one part, the body, is mounted on the corresponding moving frame and the other part, the piston member, is mounted on the arm.

This invention relates to a roll handling machine, in which:

a) greater degrees of freedom are given to the arms, to extend the use of a given machine to rolls of different types (width and/or size), b) non-rigid devices are included in the supports to aid roll loading/unloading, c) means for slight displacement of the roll-bearing axes from the centre are included to ensure a uniform tension over the entire width of a roll.

BRIEF DESCRIPTION OF THE SEVERAL VIEWS OF THE DRAWINGS

FIG. 1 shows a general diagrammatical view in plan of a roll handling machine according to the invention.

A mounted roll (B) is shown by dashed lines.

FIG. 2 shows a detailed diagrammatical view of the extender device (7) in one of its anchored positions.

FIGS. 3A and 3B show the decentering device (8) in diagrammatical form.

The three most significant positions have been shown using different types of lines:

solid lines for the fully centred position (O), dashed lines for an extreme position of maximum decentering (A), chain lines for the other extreme position of maximum decentering (B).

FIG. 4 shows a diagrammatical view in elevation of an arm (3) with its means (5) for tilting angular displacement.

DETAILED DESCRIPTION OF THE PREFERRED EMBODIMENTS

This invention relates to a roll handling machine, the frame members in a fixed frame (1) bearing movable frame members (4) in which supports (2), on which roll-bearing arms (3) are mounted, in turn move.

According to the drawing:

each pair of supports (2) is mounted on a movable frame (4) with means (41*b*) to move with respect to it between two extreme positions in the direction ($D_2$) indicated in FIG. 1, each moving frame (4) is mounted in the fixed frame (1) with means (41*a*) to move with respect to it between two extreme positions in the direction ($D_1$) indicated in FIG. 1, each support (2) is associated with an extender device (7) in which the corresponding piston (41*b*) is positioned in at least two working positions, each roll-bearing arm (3) comprises means (5) for tilting angular displacement, each roll-bearing arm (3) comprises a bearing shaft (6) in conjunction with another shaft (6) of the other arm (3) for rolls (B), each pair of roll-bearing arms (3) located in a given moving frame (4) is associated with a decentering device (8) capable of displacing the shafts (6) carrying a given roll (B) with respect to each other.

The means (41*a*) for displacing each movable frame (4) with respect to the fixed frame (1) are:

a) hydraulic pistons of which one member, for example the body, is mounted on the fixed frame (1) and the other member, e.g. the piston, is mounted on the moving frame (4), b) guides on the moving frame (4) which are housed and move within associated guides provided on the fixed frame (1).

The means (5) for tilting angular displacement of the roll-bearing arms (3) with respect to frames (1), (4) are hydraulic pistons of which one member, e.g. the piston (51) is mounted on the corresponding support (2) and the other member, e.g. the body (52), is mounted on the arm (3).

Each extender device (7) comprises supports (71), (71'), at least one of which emerges at right angles with respect to the corresponding support (2). Each support (71), (71') includes median orifices (711) to which the piston member of the corresponding hydraulic piston (41*b*) is fitted, e.g. by means of a bolt (72), for which purpose it includes a pierced head (411).

Each decentering device (8) comprises a lever (81) associated with a hydraulic circuit (82) which acts together with the two shafts (6) bearing a given roll (B). Action on lever (81) displaces shafts (6) from a coaxial equilibrium position by means of conjugated opposite movements.

Through this structural member arms (3) are provided with a greater degree of freedom and greater possibilities for movement towards or away from each other increasing the range of working widths for rolls (B).

At the same time irregular tensions which can exist in the rolls (B) are adjusted for, thus producing a uniform tension throughout the width of the roll when working.

We claim:

1. A roll handling machine comprising a movable frame (4) in a fixed frame (1), bearing roll-bearing arms (3) arranged in pairs which when mounted on arm supports (2) can move towards and away from each other, wherein:

a) the roll-bearing arms (3) have roll-bearing shafts (6) which are coaxial with each other and, when a roll (B) is mounted on said roll-bearing shafts (6), said roll-bearing shafts (6) are coaxial with the roll (B), b) each roll-bearing arm (3) is mounted on a movable frame (4) with means to displace it between two extreme positions in the fixed frame (1), c) each roll-bearing arm (3) comprises means for tilting angular displacement with respect to the movable frame (4) in which it is mounted, d) each arm support (2) is provided with an extender device (7) which allows the arm support (2) to be positioned by a piston (41*b*) into at least two working positions, and e) each pair of roll-bearing arms (3) includes decentering means (8) for decentering the roll-bearing shafts (6) for a given roll (B) to achieve a uniform tension throughout the width of the roll (B) when working, said decentering means (8) for the roll-bearing shafts (6) bearing a given roll (B) comprising a lever (81) attached to a hydraulic circuit (82) which displaces the roll-bearing shafts (6) from a coaxial equilibrium position into a conjugated and opposing movement, and wherein each extender device (7) includes supports (71, 71'), at least one of which emerges at right angles with respect to the movable frame (4), said supports (71, 71') comprising means (711) to enable the piston (41*b*) to be anchored coaxially to the supports (71, 71'), said piston (41*b*) being movable to vary the amplitude of the angular displacement of the corresponding roll-bearing arm (3).

2. A roll handling machine according to claim 1 wherein the longitudinal displacement of the movable frame with respect to the fixed frame is brought about using:

a) longitudinal female guides constructed in the fixed frame which house corresponding male guides on the movable frame, b) and wherein one part of the piston is mounted on the fixed frame and the other part of the piston is mounted on the movable frame.

3. A roll handling machine according to claim 1 wherein the tilting angular displacement of each roll-bearing arm with respect to the movable frame is brought about by means of pistons of which one part of each piston is mounted on the corresponding movable frame and the other part of each piston is mounted on the arm.

* * * * *